US010604897B2

(12) United States Patent
Goldhalm et al.

(10) Patent No.: US 10,604,897 B2
(45) Date of Patent: Mar. 31, 2020

(54) USE OF CELLULOSIC FIBERS FOR THE MANUFACTURE OF A NONWOVEN FABRIC

(71) Applicant: LENZING AG, Lenzing (AT)

(72) Inventors: Gisela Goldhalm, Neufurth (AT); Thomas Maier, Seewalchen (AT); Gert Kroner, Seewalchen (AT)

(73) Assignee: Lenzing Aktiengesellschaft, Lenzing (AT)

( * ) Notice: Subject to any disclaimer, the term of this patent is extended or adjusted under 35 U.S.C. 154(b) by 172 days.

(21) Appl. No.: 15/580,936

(22) PCT Filed: Feb. 29, 2016

(86) PCT No.: PCT/AT2016/000022
§ 371 (c)(1),
(2) Date: Dec. 8, 2017

(87) PCT Pub. No.: WO2016/197156
PCT Pub. Date: Dec. 15, 2016

(65) Prior Publication Data

US 2018/0163345 A1 Jun. 14, 2018

(30) Foreign Application Priority Data

Jun. 11, 2015 (AT) ..... 368/2015

(51) Int. Cl.
*D21H 11/18* (2006.01)
*D21H 13/08* (2006.01)
(Continued)

(52) U.S. Cl.
CPC ..... *D21H 11/18* (2013.01); *A47K 7/043* (2013.01); *D21F 11/002* (2013.01); *D21H 11/04* (2013.01);
(Continued)

(58) Field of Classification Search
CPC ..... D21H 13/08; D21H 11/18; D21H 11/04; D21H 27/30; D21H 21/24; D21H 21/56;
(Continued)

(56) References Cited

U.S. PATENT DOCUMENTS 5,725,821 A * 3/1998 Gannon ..... D01F 2/00 264/203
6,042,769 A 3/2000 Gannon et al.
(Continued)

FOREIGN PATENT DOCUMENTS

AT 515693 A 11/2015
DE 69513978 T2 5/2000
(Continued)

OTHER PUBLICATIONS

B. Radvan and A.P.J. Gatward, "The Formation of Wet-Laid Webs by a Foaming Process," Tappi, 55(5), pp. 748-751 (1972).
(Continued)

*Primary Examiner* — Eric Hug
(74) *Attorney, Agent, or Firm* — Venable LLP

(57) ABSTRACT

This invention relates to the use of Lyocell fibers with a tendency to fibrillate for the manufacture of a nonwoven fibrous web material, in particular for the use in a wipe, by using a foam technique.

26 Claims, 2 Drawing Sheets

Figure 1:
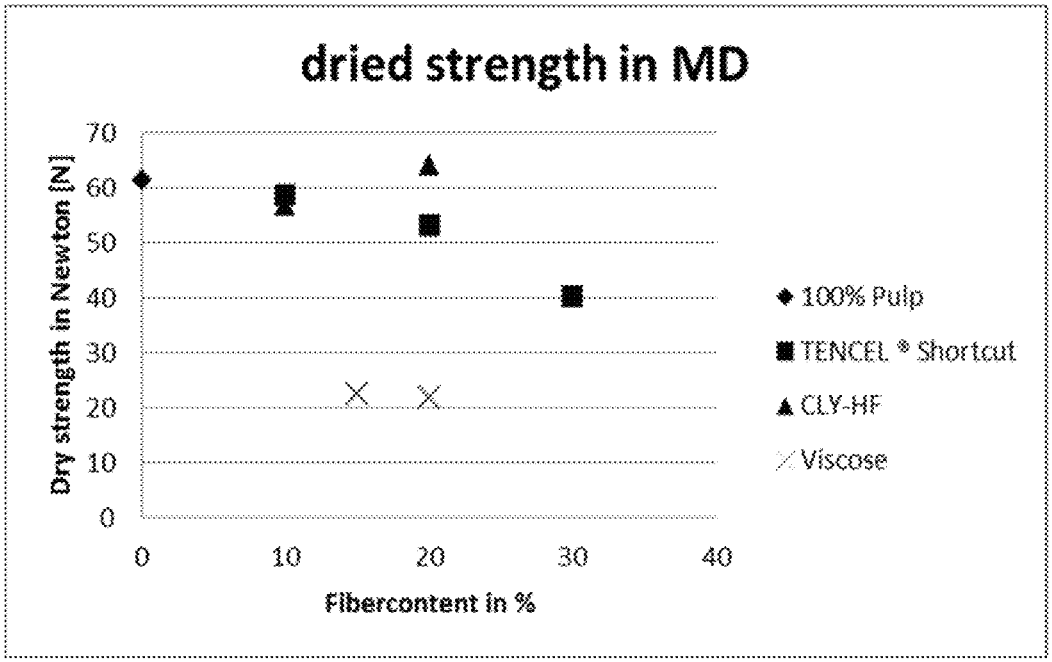
Figure 2:
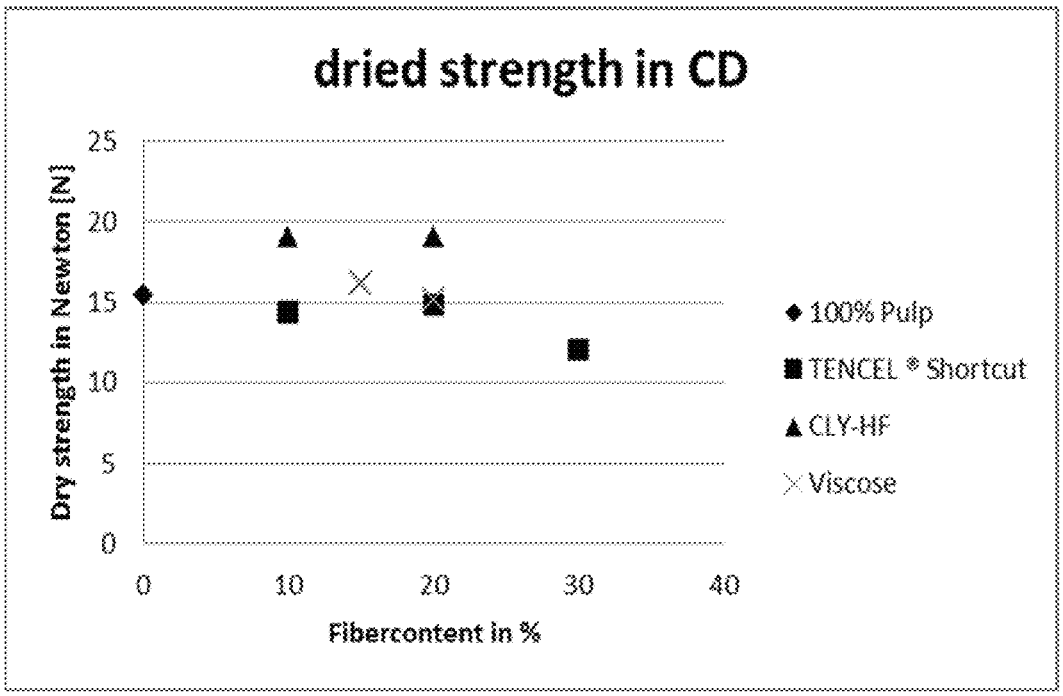

(51) Int. Cl.

| | |
|---|---|
| ***D21F 11/00*** | (2006.01) |
| ***D21H 21/24*** | (2006.01) |
| ***D21H 21/56*** | (2006.01) |
| ***D21H 27/00*** | (2006.01) |
| ***D21H 27/30*** | (2006.01) |
| ***D21H 21/20*** | (2006.01) |
| ***A47K 7/04*** | (2006.01) |
| ***D21H 11/04*** | (2006.01) |

(52) U.S. Cl.
CPC ..... *D21H 13/08* (2013.01); *D21H 21/20* (2013.01); *D21H 21/24* (2013.01); *D21H 21/56* (2013.01); *D21H 27/002* (2013.01); *D21H 27/30* (2013.01)

(58) Field of Classification Search
CPC .... D21H 21/20; D21H 27/002; D21F 1/0009; D21F 11/006; D21F 11/14; D21F 11/002
USPC ..... 162/146, 157.6, 157.7
See application file for complete search history.

(56) References Cited

U.S. PATENT DOCUMENTS

| | | | | |
|---|---|---|---|---|
| 6,235,392 | B1 | 5/2001 | Luo et al. | |
| 6,602,994 | B1 | 8/2003 | Cash et al. | |
| 8,187,422 | B2 | 5/2012 | Sumnicht et al. | |
| 9,222,222 | B2 * | 12/2015 | Dodd | D21H 13/02 |
| 10,030,323 | B2 | 7/2018 | Durnberger et al. | |
| 2007/0224419 | A1 | 9/2007 | Sumnicht et al. | |
| 2009/0020139 | A1 | 1/2009 | Sumnicht et al. | |
| 2010/0288456 | A1 | 11/2010 | Westland et al. | |
| 2012/0043038 | A1 | 2/2012 | Dodd | |
| 2012/0180815 | A1 | 7/2012 | Sumnicht et al. | |
| 2013/0029106 | A1 * | 1/2013 | Lee | D21H 27/002 428/172 |
| 2014/0004326 | A1 * | 1/2014 | Petersen | D04H 1/425 428/219 |
| 2014/0144466 | A1 | 5/2014 | Sumnicht et al. | |
| 2014/0144598 | A1 | 5/2014 | Sumnicht et al. | |
| 2015/0114581 | A1 | 4/2015 | Kinnunen et al. | |
| 2015/0122432 | A1 | 5/2015 | Sumnicht et al. | |
| 2015/0122434 | A1 | 5/2015 | Sumnicht et al. | |
| 2015/0122435 | A1 | 5/2015 | Sumnicht et al. | |
| 2015/0122436 | A1 | 5/2015 | Sumnicht et al. | |
| 2015/0122437 | A1 | 5/2015 | Sumnicht et al. | |
| 2015/0122438 | A1 | 5/2015 | Sumnicht et al. | |
| 2015/0122439 | A1 | 5/2015 | Sumnicht et al. | |
| 2015/0129147 | A1 | 5/2015 | Sumnicht et al. | |
| 2015/0144157 | A1 | 5/2015 | Sumnicht et al. | |
| 2015/0144158 | A1 | 5/2015 | Sumnicht et al. | |
| 2015/0144281 | A1 | 5/2015 | Sumnicht et al. | |
| 2015/0164295 | A1 | 6/2015 | Sumnicht et al. | |
| 2015/0173581 | A1 | 6/2015 | Sumnicht et al. | |
| 2015/0173582 | A1 | 6/2015 | Sumnicht et al. | |
| 2015/0173583 | A1 | 6/2015 | Sumnicht et al. | |
| 2015/0176215 | A1 | 6/2015 | Sumnicht et al. | |
| 2015/0182092 | A1 | 7/2015 | Sumnicht et al. | |
| 2016/0060792 | A1 | 3/2016 | Durnberger et al. | |
| 2017/0241079 | A1 | 8/2017 | Manner et al. | |
| 2017/0328012 | A1 | 11/2017 | Lee et al. | |

FOREIGN PATENT DOCUMENTS

| | | | | |
|---|---|---|---|---|
| GB | 1395757 | | 5/1975 | |
| JP | 2003-278091 | * | 10/2003 | D21H 13/08 |
| WO | 95/35399 | A1 | 12/1995 | |
| WO | 2013/160553 | A1 | 10/2013 | |
| WO | WO 2013/160553 | * | 10/2013 | D21H 11/18 |
| WO | 2016/065377 | A1 | 5/2016 | |

OTHER PUBLICATIONS

"New Process Uses Foam in Papermaking Instead of Avoiding It" Paper Trade Journal (1971).

M.K. Smith, et al., "The structure and properties of paper formed by a foaming process," Tappi, 57(1), pp. 107-111 (1974).

International Search Report and Written Opinion issued in corresponding International Application No. PCT/AT2016/000022 (7 pages).

* cited by examiner

USE OF CELLULOSIC FIBERS FOR THE MANUFACTURE OF A NONWOVEN FABRIC

The present application is a national-stage entry under 35 U.S.C. § 371 of International Patent Application No. PCT/AT2016/000022, filed Feb. 29, 2016, which claims priority to Austrian Patent Application No. A 368/2015 filed Jun. 11, 2015, the entire disclosure of each of which is incorporated by reference herein.

BACKGROUND OF THE INVENTION

Field of the Invention

This invention relates to the use of Lyocell fibers with a tendency to fibrillate for the manufacture of a nonwoven fibrous web material, in particular for the use in a wipe, by using a foam technique. For the purposes of the present invention such nonwoven fibrous web materials are also referred to as papers and vice versa and terms like "paper machine", "paper making" etc. should be understood accordingly.

Prior Art

In the paper industry foam technique, where foam is used as a carrier phase of materials, has been used in both web formation and web coating processes. The technique is described e.g. in the publications Radvan, B., Gatward, A. P. J., The formation of wet-laid webs by a foaming process, Tappi, vol 55 (1972) p. 748; a report by Wiggins Teape Research and Development Ltd., New process uses foam in papermaking instead of avoiding it, Paper Trade Journal, Nov. 29, 1971; and Smith, M. K., Punton, V. W., Rixson, A. G., The structure and properties of paper formed by a foaming process, TAPPI, January 1974, Vol. 57, No 1, pp. 107-111.

In GB 1 395 757 there is described an apparatus for producing a foamed fiber dispersion for use in the manufacture of paper. A surface active agent is added to fibrous pulp with a fiber length in excess of about 3 mm, to provide a dispersion with an air content of at least 65%, to be discharged onto the forming fabric of a papermaking machine. The aim is to achieve uniform formation of the fibrous web on the fabric.

By the middle of the 1970s the foam forming process had been successfully demonstrated on a production machine. In the Wiggins Teape Radfoam process (Arjo Wiggins) fibers were delivered to the sieve-belt (a sieve-belt herein also referred to as "wire"—a term used by the experts skilled in the art) of a conventional Fourdrinier paper machine in suspension in aqueous foam. The development team obtained a non-layered 3D structure in papers made on a Fourdrinier machine at very high concentrations of fibers (3-5%) in water using foam.

When comparing foam and water forming methods one trend seems to be clear from the prior art: With foam forming the bulk is bigger, but the tensile index is smaller which may be a disadvantage with regard to many applications of such materials. With a bulkier structure the structure is more porous, which leads to smaller tensile index values. An interesting result from a comparison of water and foam laid samples was that tensile strengths in both cases were very close even though foam formed samples were much bulkier. The reason for that is currently unknown and requires further research.

According to current understanding of the main problems, which have prevented foam forming from becoming a standard web forming technology in paper, paperboard and cardboard production, are:

- too high porosity in some applications,
- reduced strength properties compared to normal low consistency wet forming,
- inferior tensile strength, and
- inferior elastic modulus.

With foam forming a higher bulk (lower density) can be obtained as compared to normal wet forming. For typical printing and packaging paper and board grades the main drawbacks are the loss of elastic modulus ("softness") and internal strength. However, the same characteristics are advantages in tissue making. Thus foam forming has been much more common in tissue paper products, e.g. wipes.

A more recent approach of improved papermaking, aiming at improving de-watering and retention of papermaking chemicals in a fibrous web formed on a forming fabric, is incorporation of microfibrillated cellulose (MFC) in the pulp suspension. U.S. Pat. No. 6,602,994 B1 teaches use of derivatized MFC with electrostatic or steric functionality for the goals, which even include better formation of the web. According to this document the microfibrils have a diameter in the range of 5 to 100 nm. However, the drawbacks experienced with MFC are densification and high drying shrinkage of the paper, as well as a tendency of MFC to absorb and retain a substantial amount of water, which increases the energy required for drying and reduces paper machine speed and productivity. For these reasons MFC has not won extensive use in paper industry so far. Moreover the manufacture of derivatized MFCs is costly due to the additional chemical derivatisation step and the functional groups on the cellulose chain may change the properties of the final product in a disadvantageous way.

WO 2013/160553 discloses an approach to overcome or substantially reduce the above problems regarding printing and packaging papers and boards, by way of finding a method of making a foam formed fibrous web, lending a substantially increased strength to paper and board products while preserving the low density. The solution according to WO 2013/160553 is production of a web through the steps of (i) providing a foam of water and a surfactant, (ii) incorporating microfibrillated cellulose together with a pulp of a greater fiber length in the foam, (iii) supplying the foam onto a forming fabric, (iv) dewatering the foam on the forming fabric by suction to form a web, and (v) subjecting the web to final drying. In particular, WO 2013/160553 discloses that a pulp of a high fiber length, mechanical or chemical, can be advantageously used in foam forming in combination with microfibrillated cellulose. Even though use of MFC in papermaking is known as such, incorporation of MFC into a foam is considered as not having been suggested in the prior art, and the benefits were not foreseeable to a skilled person. Nevertheless the web-forming method according to WO 2013/160553 requires the energy-consuming step of pretreating the cellulose in order to obtain microfibrillation and the resulting web still lacks sufficient strength required for many applications such as in wipes for household, body care, hygiene etc.

Problem

In view of this prior art the problem to be solved by this invention was to provide a nonwoven fibrous web material with sufficient strength, even in rewetted state which can be manufactured with less pretreatment steps of the raw materials.

Description

It is an object of the present invention to overcome or substantially reduce the above problems regarding papers, in particular for use in wipes, by way of finding a method of making a foam-formed fibrous web, lending a substantially increased strength to the paper products, and particularly wipes while preserving the low density.

The solution according to the invention is the manufacture of a fibrous web of paper comprising the steps of (i) providing a foam of water and a surfactant, (ii) incorporating Lyocell fibers together with a pulp of a greater fiber length in the foam, (iii) supplying the foam onto a forming fabric, (iv) dewatering the foam on the forming fabric by suction to form a web, and (v) subjecting the web to final drying. Surprisingly it was found that the use of Lyocell fibers leads to fibrous web materials with increased strength as will be shown below.

Preferably the Lyocell fibers are Lyocell fibers with a titer of between 0.5 and 30 dtex, preferably between 0.9 and 15 dtex, especially preferred between 0.9 and 4 dtex, and a fibrillation coefficient Q of between 10 and 50. The fibrillation coefficient Q is defined as $$Q=200/t_{CSF200}$$

Therein $t_{CSF200}$ is the time (in min) needed to obtain a CSF value of 200 in the CSF test. The CSF test will be performed with a staple length of 5 mm and thereafter be tested according to Canadian Standard Freeness-TAPPI Standard T227 om-94. The larger Q is, the shorter is the time needed to obtain the same degree of fibrillation under the same fibrillation conditions.

Depending on the kind of the fibrous starting material a Q-value of up to 65 can be obtained and therefore in another preferred embodiment of the invention the Lyocell fibers are Lyocell fibers with a titer of between 0.5 and 30 dtex, preferably between 0.9 and 15 dtex, especially preferred between 0.9 and 4 dtex, and a fibrillation coefficient Q of between 10 and 65.

In a preferred embodiment the Lyocell fibers are Lyocell fibers with an increased tendency to fibrillate (herein also referred to as CLY-HF, i.e "Lyocell-High-Fibrillating"). Such Lyocell fibers show a fibrillation coefficient Q of between 20 and 50. Depending on the kind of the fibrous starting material a Q-value of up to 65 can be obtained and therefore in another preferred embodiment of the invention the Lyocell fibers are Lyocell fibers with a titer of between 0.5 and 30 dtex, preferably between 0.9 and 15 dtex, especially preferred between 0.9 and 4 dtex, and a fibrillation coefficient Q of between 20 and 65. To enhance the fibrillation in a continuous process an additional refining of the fibers before the foam-forming step could enhance the CSF value and therefore the physical properties of the fibrous web will improve.

In a preferred embodiment the Lyocell fibers are Lyocell fibers with a cut length of between 1 and 40 mm, particularly preferred between 2.5 and 22 mm, especially preferred between 3 and 12 mm, and in particular preferred between 4 and 10 mm. Shorter Lyocell fibers will not enhance the physical properties of the fibrous web and longer Lyocell fibers cannot be dispersed with sufficient homogeneity within the whole process.

The pulp to be combined with Lyocell fibers by definition has a relatively great fiber length, preferably about 1 mm or more. Preferred is a pulp with a weight weighted average fiber length of between 1.5 and 4 mm. This weight weighted average length means that the pulp also can contain a certain percentage of shorter or longer fibers. In particular preferred is a pulp with a maximum length of 6 mm of the longest fibers.

In particular, it has surprisingly been found that a pulp of a high fiber length, can be advantageously used in foam forming in combination with Lyocell fibers.

In a particularly preferred embodiment of the present invention the ratio of the average length of the Lyocell fibers to the average length of the pulp fibers is between 1:1 and 10:1 (length of Lyocell fibers:length of pulp fibers).

A method to produce the CLY-HF known in the prior art is disclosed in U.S. Pat. No. 6,042,769. U.S. Pat. No. 6,042,769 discloses a method by means of which the fibrillation tendency of Lyocell fibers is increased through a treatment that reduces the degree of polymerization of the cellulose by at least 200 units. The fiber obtained in this way should be used especially in nonwovens and paper. Preferably, the treatment is carried out with a bleaching agent, especially with sodium hypochlorite. Alternatively, treatment with acid, preferably with a mineral acid such as hydrochloric acid, sulfuric acid, or nitric acid, is also possible. This method has so far not been implemented on a commercial scale.

It was also possible to produce the required CLY-HF by subjecting conventional Lyocell fibers to an acid treatment. This acid treatment can be performed by impregnating fiber tow extruded from spinnerets in a known manner according to the lyocell process and having an individual fiber titer between 1.0 and 6.0 dtex, with diluted mineral acid such as hydrochloric, sulfuric or nitric acid, for example, having a concentration between 0.5 and 5% at room temperature in a vessel at a liquor ratio of for example 1:10 and then pressing it to a certain residual moisture of, for example, 200%. Subsequently, the impregnated fiber tow is subjected to steam at positive pressure in a suitable apparatus, and then washed free of acid and dried.

Long fiber pulps particularly useful in the invention are chemical pulps, chemimechanical pulp (CMP), thermomechanical pulp (TMP), chemothermomechanical pulp (CTMP), GW, and other high yield pulps such as APMP and NSSC.

Without being bound to any theory it is believed that in the combination the long pulp fibers provide the bulky structure and the Lyocell fibers provide the bonding between the long fibers. The method according to the invention has been found to achieve a bulk of between 2.5 $cm^3/g$ and 15 $cm^3/g$, preferably of between 8.0 $cm^3/g$ and 11 $cm^3/g$.

In the foam forming Lyocell is able to build bridges between individual long fibers thus lend surprisingly good strength properties to the web.

As foam forming prevents flock formation between long fibers, very good grammage formation can be gained. This improves the evenness of the print quality as there is less calibre variation in the paper.

These stiff long fibers are able to maintain the bulky structure in wet pressing and drying thus giving surprisingly good bulk for the sheet.

An interesting result in comparison of water and foam laid samples was that tensile strength was very close in both cases even though the foam formed samples were much bulkier. The reason for that is currently unknown and it needs more research.

According to an embodiment of the invention a continuous fibrous web is formed in an industrial scale on a running forming fabric of a paper machine, dewatered by suction through the web and the forming fabric, and finally dried in a drying section of the paper machine. Instead of dewatering on the running forming fabric of a paper machine, which usually is a flat endless belt, the dewatering can also be performed for example on a three-dimensional, water-permeable mould which allows for retaining of the fibers but removal of the water. In this embodiment of the invention the drying will be performed by hot air, microwave drying or other suitable drying methods which are in general known by the skilled in the art. By this embodiment of the invention three-dimensional bodies can be manufactured which are e.g. suitable as packaging or isolating materials.

Another embodiment of the invention comprises dewatering the web by suction of air through the web and the forming fabric at a pressure of at most 0.6 bar, followed by predrying by suction of air at a pressure of at most about 0.3 bar.

According to a further embodiment of the invention the fibrous components incorporated in the foam consist of about 5 to 40 wt-%, preferably 10 to 40 wt-% and most preferably 10 to 25 wt-% of Lyocell fibers and about 60 to 95 wt-%, preferably 60 to 90 wt-% and most preferably 75 to 90 wt-% of pulp with longer fibers. "Longer fibers" means a weight weighted average fiber length of between 1.5 and 4 mm. In particular preferred is a pulp with a maximum length of 6 mm of the longest fibers.

According to a still further embodiment of the invention the foam is brought to an air content of 60 to 70 vol-% before being supplied onto the forming fabric. The consistency of the pulp subjected to foaming may be 1 to 2% based on the amount of water. Suitable amount of surfactant in the foam may be in the range of 0.05 to 2.5 wt-%, but will be easily determinable by a skilled person.

The preferred surfactant for use in the invention is sodium dodecyl sulphate (SDS), but other typical surfactants may be used as well. Foam forming by use of long cellulosic fibers and added Lyocell fibers in the foam is thus very suitable and promising method for producing all paper grades needing best possible formation combination with best possible bending stiffness.

The fibrous web according to the invention, which is obtainable by the method as described in the above, comprises a mixture of Lyocell fibers and a pulp of a greater fiber length as outlined above, and has a bulk of between 2.5 $cm^3/g$ and 15 $cm^3/g$, preferably of between 8.0 $cm^3/g$ and 11 $cm^3/g$. Bulk is calculated as $((\text{weight per unit area})\times(\text{thickness}))^{-1}$. In a preferred embodiment the Lyocell fibers are Lyocell fibers with an increased tendency to fibrillate ("CLY-HF").

In a preferred embodiment the Lyocell fibers in the fibrous web are Lyocell fibers with a cut length of between 1 and 40 mm, particularly preferred between 2.5 and 22 mm, especially preferred between 3 and 12 mm, and in particular preferred between 4 and 10 mm. Shorter Lyocell fibers will not enhance the physical properties of the fibrous web and longer Lyocell fibers cannot be dispersed with sufficient homogeneity within the whole process.

In general the fibrous web comprises about 5 to 40 wt-% of Lyocell fibers and about 60 to 95 wt-% of pulp with longer fibers. Preferably the fibrous web comprises 10 to 40 wt-% and most preferably 10 to 25 wt-% of Lyocell fibers and about 60 to 95 wt-%, preferably 60 to 90 wt-% and most preferably 75 to 90 wt-% of pulp with longer fibers. "Longer fibers" means a weight weighted average fiber length of between 1.5 and 4 mm. In particular preferred is a pulp with a maximum length of 6 mm of the longest fibers.

Such products include for example all paper grades suitable for nonwoven products such as but not limited to wipes, in particular wet wipes, baby wipes, cosmetic wipes, facial masks, other body care wipes, wipes for technical and cleaning uses, toilet tissues, etc.

The high bulk high strength structure achieved according to the invention can also be used for example:

- as middle layer in multilayer structures (papers and boards),
- in lamination to other paper structures and/or plastic film layers,
- as fibrous base for extrusion coating with plastics,
- as heat insulation, noise insulation, liquid and moisture absorber,
- as formable layer in moulded structures such as trays, cups, containers.

As the fibrous web according to the invention can be used as a single layer in a multilayer paperboard or cardboard, it is preferably positioned as a middle layer, while the outer surface layers may be fibrous webs of a lower bulk than said middle layer. However, it is possible to produce all the layers of a multilayer board by the foam forming technique according to the invention.

Another aspect of the present invention is the use of the fibrous web described herein for the manufacture of a wipe, wherein the fibrous web is used as at least one layer of the wipe. For example the fibrous web can be used as a middle layer of the wipe while the wipe further contains outer layers having a bulk lower than in the middle layer.

Possible uses of the fibrous web according to the invention can also be, among others, dispersible wet wipes, flushable wipes, dry wipes, paper towels, facial masks (also flushable facial masks), napkins, disposable tablecloths, absorbent core products, sealing materials and the like.

The invention will now be illustrated by examples. These examples are not limiting the scope of the invention in any way. The invention includes also any other embodiments which are based on the same inventive concept.

EXAMPLES

Example 1: Manufacture of CLY-HF

Fast fibrillating Lyocell fibers according to the invention are manufactured as follows: a Lyocell fiber tow having an individual fiber titer of 1.7 dtex is impregnated with diluted sulfuric acid at room temperature and a liquor ratio of 1:10 and pressed to approximately 200% moisture. The impregnated fiber tow is subjected to steam under pressure for approximately 10 min in a laboratory steamer, then washed free of acid with water, and dried. The dry fiber tow is cut to a staple length of 6 mm.

Example 2: Forming of Nonwoven Web

The webs were manufactured according to the following general procedure:

Raw Materials Used:

Pulp: A commercially available longfiber spruce Kraft pulp with a weight weighted average fiber length of 2.6 mm.

Man-made fibers (the content of these fibers hereinafter is named "Fiber content" while the remaining quantity is pulp)—see Table 1:

a. Lyocell shortcut fiber made by Lenzing Aktiengesellschaft, Austria according to a conventional Lyocell process and cut to 6 mm staple length; titer 1.7 dtex; commercially available as Tencel® Shortcut b. Viscose fiber with rectangular cross-section; 10 mm staple length, titer 2.4 dtex; commercially available ("Viscose")

c. The fiber made according to Example 1; 6 mm staple length, titer 1.7 dtex ("CLY-HF")

TABLE 1

| Example | Fiber type | Pulp [wt. %] | Fiber [wt. %] |
|---|---|---|---|
| 2A | None | 100 | 0 |
| 2B | Tencel ® Shortcut | 90 | 10 |
| 2C | Tencel ® Shortcut | 80 | 20 |
| 2D | Tencel ® Shortcut | 70 | 30 |
| 2E | Viscose | 85 | 15 |
| 2F | Viscose | 80 | 20 |
| 2G | CLY-HF | 90 | 10 |
| 2H | CLY-HF | 80 | 20 |

The trial set-up at the pilot-scale paper machine SUORA included using foam generation in a pulper and a hybrid former (containing the head box and the dewatering and defoaming section). A pulp suspension was prepared by filling the required amount of water into the pulper and then adding the pulp while stirring. Thereafter sodium dodecyl sulfate (SDS, a tenside) was dosed into the pulper at a feed rate adjusted to control the foam density (target foam density 500 kg/m$^3$). Then the production phase was started. When all steps of the process were stabilized the man-made fiber was added into the pulper to obtain the ratio pulp:man-made fiber according to Table 1. At the hybrid former the basis weight per unit area target for the nonwoven samples was set to 70 gsm in all trials. The machine speed was 500 m/min in all trials and the wet pressing load at the final dewatering pressing unit was 600 kN/m. After this squeezing the nonwoven material thus formed was collected on a winding unit. At this wet pressing load the solids content of the nonwoven material at the winding unit ranged from 38.9%-46.3%. The samples were dried in a discontinuous laboratory drum drier and reconditioned before testing.

The tensile strength values which are listed below were measured according to DIN 29073 Teil 3 (identical to ISO 9073-3) in machine direction (MD) and cross direction (CD). The values which are measured here are the maximum force at break in the unit Newton as well as the elongation in %.

The results of Example 2 show that the papers made according to the invention showed even in the original dried state an equal or even higher tenacity (i.e. strength) in both directions as papers consisting of pure pulp, while the blends with other man-made cellulosic fibers always show decreased tenacity compared to pure pulp paper made according to the same procedure.

Another possible method to produce foam-formed products in lab scale is the forming of handsheets according to the following procedure, which gives comparable results: Foam laid handsheets of the size of a A4 piece of paper were made by the following procedure: Foam was produced by mixing water and sodium dodecyl sulphate (SDS) as a surface active agent in ratio 0.15-0.2 g/l with a stirrer (3500 rpm) as far as the air content of foam is 60-70%. The target air content of foam was determined by the foaming set-up; when the foam reaches the target air content the level of the foam surface does not rise anymore and the mixing starts to decrease the bubble size of the foam. When the foam was ready a fiber suspension comprising CLY-HF (produced according to Example 1) and the pulp in the ratios according to Table 1 was mixed with the prefabricated foam. Mixing was continued until the target air content was reached again. In stable condition the distances between fibrous particles in the foam remained constant and no flocculation happened. After that the foam was decanted into a handsheet mold and filtrated through a wire using an exhauster and a vacuum chamber. The wire was of the type conventionally used for water based forming. Then the wire and the handsheet formed thereon were removed from the mold and pre-dried on a suction table by use of an exhauster. The suction table has a suction slit, width 5 mm that suck air through the sheet with 0.2 bar vacuum. The webs were dried according to the following method: The wet sample sheets in the size of A4 were dried on a special drum dryer: This dryer rotates (1 cycle within 3 minutes) to dry the sample to a bone dry state. To transport the sheet over the rotating drum, a woven fabric presses the sample onto the heated drum. As a certain area at the bottom end of the dryer is open, the sheet falls down into a gathering section when passing through the whole process. After drying the bone dry sheets are reconditioned in a reconditioning room overnight.

Example 3: Rewetting of Dried Nonwoven Webs

Figure 3:
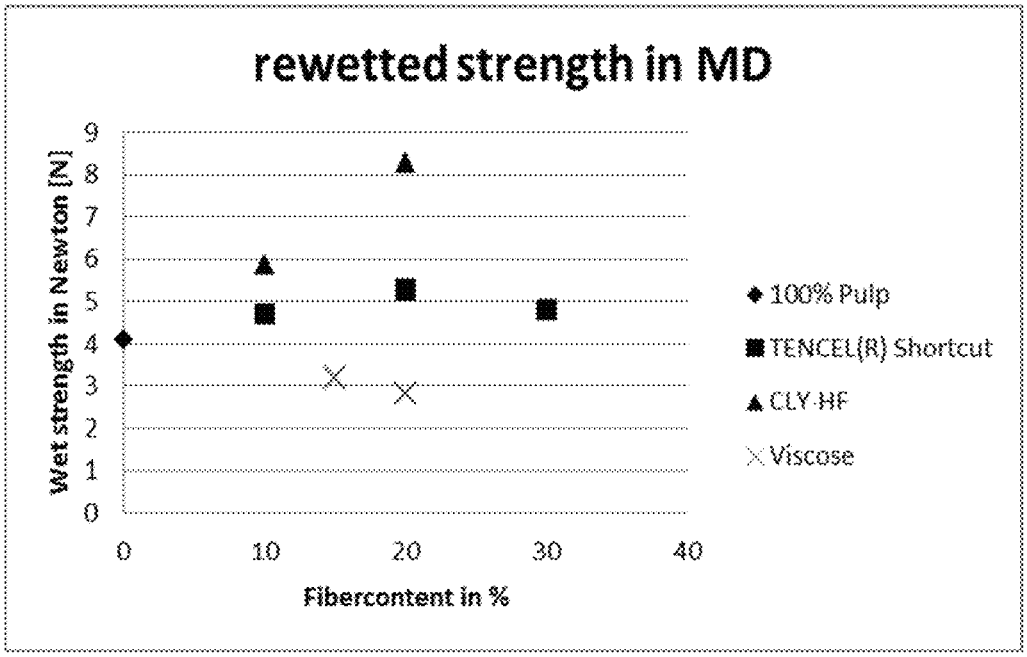
Figure 4:
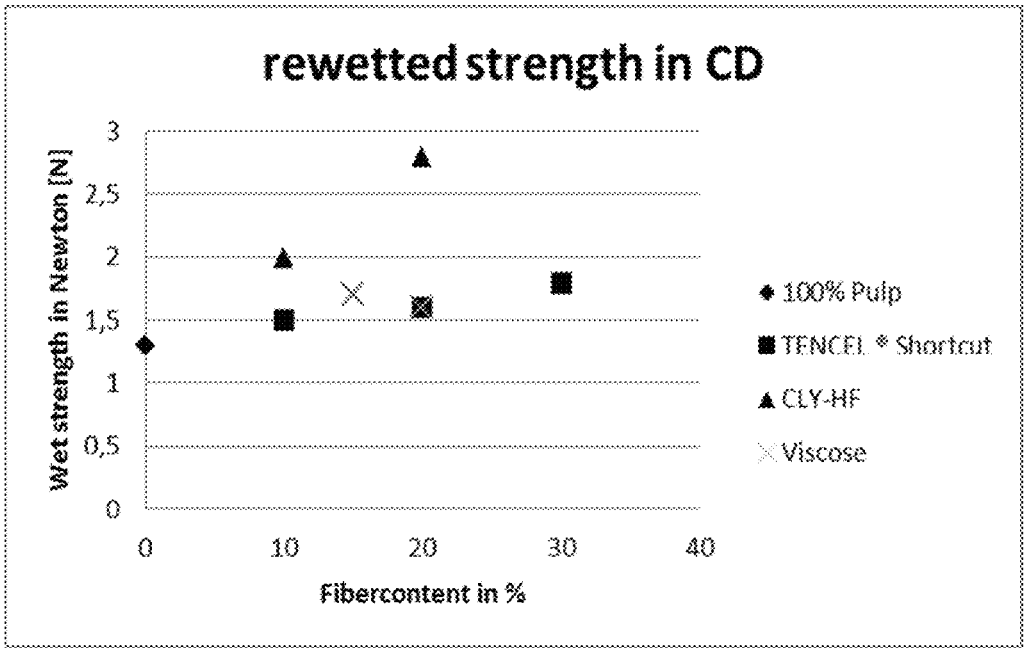

The tensile strength values which are shown in FIG. 3 and FIG. 4 were measured according to DIN 29073 Teil 3 (identical to ISO 9073-3) in machine direction (MD) and cross direction (CD). In this example the samples were rewetted with 150 w.-% of water to 2.5 times its dry weight.

The rewetted state is the state commercially relevant as wet wipes are usually produced by the converter (the roll good producer produced the fabric, the converter converts the fabric by adding lotion and slitting the wipe to its needed size).

According to Example 3 in the rewetted state the papers made according to the invention show a gain in wet strength compared to the 100% pulp product. Also when comparing the papers made according to the invention to the other fibers, the CLY-HF again shows a benefit. This effect is seen clearly in MD as well as in CD.

Resume:

Over all samples, compared to the rewetted state, the strength of the sheets made according to the invention are higher. When increasing the fiber content into the sheets, the tensile strength goes down. Lyocell fiber herewith does not show this effect. In MD the tensile strength is comparable, in CD there is a gain in tensile strength.

What is claimed is:

1. A method for the manufacture of a fibrous web of paper, comprising the steps of:

a. providing a foam of water and a surfactant, b. incorporating Lyocell fibers and a pulp into the foam, wherein the Lyocell fibers have a titer of between 0.5 and 30 dtex, and a fibrillation coefficient Q of between 10 and 65, and wherein fibers in the pulp have a greater fiber length than the Lyocell fibers, c. supplying the foam onto a forming fabric, d. dewatering the foam on the forming fabric by suction to form a web, and e. subjecting the web to final drying.

2. The method of claim 1, wherein the the fibrillation coefficient Q of the Lyocell fibers is between 10 and 50.

3. The method of claim 1, wherein the Lyocell fibers are Lyocell fibers with an increased tendency to fibrillate.

4. The method of claim 1, wherein a continuous fibrous web is formed on a running forming fabric of a paper machine, dewatered by suction through the web and the forming fabric, and finally dried in a drying section of the paper machine.

5. The method of claim 1, wherein the web is dewatered by suction of air through the web and the forming fabric at a pressure of at most 0.6 bar, followed by predrying by suction of air at a pressure of at most about 0.3 bar.

6. The method of claim 1, wherein about 5 to 40 wt-%, of the Lyocell fibers and about 60 to 95 wt-%, of the pulp are incorporated into the foam.

7. The method of claim 1, wherein the foam is brought to an air content of 60 to 70 vol-% before being supplied onto the forming fabric.

8. The method of claim 1, wherein the titer of the Lyocell fibers is between 0.9 and 15 dtex.

9. The method of claim 6, wherein about 10 to 40 wt-% of the Lyocell fibers are incorporated into the foam.

10. The method of claim 9, wherein about 10 to 25 wt-% of the Lyocell fibers are incorporated into the foam.

11. The method of claim 6, wherein about 60 to 90 wt-% of the pulp is incorporated into the foam.

12. The method of claim 11, wherein about 75 to 90 wt-% of the pulp is incorporated into the foam.

13. A fibrous web obtainable by the method of claim 1, wherein the web has a bulk of at least 2.5 $cm^3/g$.

14. The fibrous web of claim 13, wherein the the fibrillation coefficient Q of the Lyocell fibers is between 10 and 50.

15. The fibrous web of claim 13, wherein the Lyocell fibers are Lyocell fibers with an increased tendency to fibrillate.

16. The fibrous web of claim 13, wherein the web has the bulk of between 2.5 $cm^3/g$ and 15.0 $cm^3/g$.

17. The fibrous web of claim 13, wherein the web comprises about 5 to 40 wt-%, of the Lyocell fibers and about 60 to 95 wt-%, of the pulp.

18. The fibrous web of claim 13, wherein the web has the bulk of between 8.0 $cm^3/g$ and 11 $cm^3/g$.

19. The fibrous web of claim 13, wherein the titer of the Lyocell fibers is between 0.9 and 15 dtex.

20. The fibrous web of claim 17, wherein the web comprises about 10 to 40 wt-% of the Lyocell fibers.

21. The fibrous web of claim 20, wherein the web comprises about 10 to 25 wt-% of the Lyocell fibers.

22. The fibrous web of claim 17, wherein the web comprises about 60 to 90 wt-% of the pulp.

23. The fibrous web of claim 22, wherein the web comprises about 75 to 90 wt-% of the pulp.

24. A wipe comprising the fibrous web of claim 13, wherein the fibrous web is used as at least one layer of the wipe.

25. The wipe according to claim 24, wherein the fibrous web comprises a middle layer of the wipe and the wipe further comprises outer layers having a bulk lower than in the middle layer.

26. The wipe of the fibrous web of claim 24, wherein the wipe is selected from the manufacture of dispersible wet wipes, flushable wipes, dry wipes, paper towels, face masks, flushable face masks, napkins, disposable tablecloths, absorbent core products, sealing materials, wet wipes, baby wipes, cosmetic wipes, other body care wipes, wipes for technical and cleaning uses and toilet tissues.

* * * * *